United States Patent [19]

Hansen

[11] 4,258,795

[45] Mar. 31, 1981

[54] ON-OFF SPRINKLER HEAD HAVING AN OFFSET DRIVE MOTOR

[75] Inventor: Arne H. Hansen, Doylestown, Pa.

[73] Assignee: Central Sprinkler Corporation, Landsdale, Pa.

[21] Appl. No.: 18,680

[22] Filed: Mar. 8, 1979

[51] Int. Cl.[3] ..... A62C 37/06

[52] U.S. Cl. ..... 169/19; 137/79; 169/90; 236/100; 239/75

[58] Field of Search ..... 169/5, 19, 37–41, 169/90; 236/99 G, 100; 239/75; 137/60, 79

[56] References Cited

U.S. PATENT DOCUMENTS

| | | | |
|---|---|---|---|
| 2,155,990 | 4/1939 | Hodgman, Jr. . | |
| 2,291,818 | 4/1942 | Loepsinger | 169/37 |
| 2,768,696 | 10/1956 | Sherburne | 169/37 |
| 3,007,528 | 11/1961 | Gloeckler . | |
| 3,257,573 | 5/1966 | Miller et al. | 236/99 G X |
| 3,734,191 | 5/1973 | Johnson et al. | 169/41 X |
| 3,874,455 | 4/1975 | Klesow | 169/19 |
| 4,089,461 | 5/1978 | Gocke | 236/100 X |

*Primary Examiner*—Robert J. Spar
*Assistant Examiner*—Fred A. Silverberg
*Attorney, Agent, or Firm*—Fishburn, Gold & Litman

[57] ABSTRACT

An on-off sprinkler head for fire extinguishing systems comprises a housing having a central cavity with an inlet aperture and a discharge orifice disposed at opposing ends thereof in an aligned orientation. A reciprocating valve having a valve head, a mating seat, and a stem is mounted axially in the central cavity, and controls the flow of fire extinguishing fluid therethrough. A temperature responsive, on-off drive motor is connected with the free end of the valve stem, and reciprocates the valve head with respect to the valve seat in response to selected temperature changes. The drive motor is mounted in the housing in a position axially offset from the aligned inlet aperture and discharge orifice, whereby during a discharge condition, the fire extinguishing fluid flows substantially unimpeded through the valve, and a solid, uninterrupted stream of fluid is emitted from the discharge orifice. The valve includes a deflector plate on which the fluid stream impinges and is dispersed into a spray.

1 Claim, 3 Drawing Figures

ON-OFF SPRINKLER HEAD HAVING AN OFFSET DRIVE MOTOR

BACKGROUND OF THE INVENTION

This invention relates to on-off sprinkler heads for fire extinguishing systems, and in particular to a sprinkler head with a reciprocating valve and offset drive motor arrangement.

Sprinkler heads are used in automatic fire extinguishing systems for buildings, and the like, to quickly extinguish and/or control fires therein. Conventional sprinkler heads include a fusible element which melts at a predetermined temperature, and opens the valve portion of the sprinkler head to permit a fire extinguishing fluid, such as water, to be sprayed therefrom into the area surrounding the sprinkler head. Such sprinkler heads are of the "one-shot" type, in that they do not automatically close and reset once the fire in the associated area has been extinguished. Rather, such sprinkler heads continue to emit water until the central water supply valve has been shut off.

On-off sprinkler heads have been developed with actuator and drive motor assemblies, which automatically open and close the valve portion of the sprinkler head in response to temperature variations within the associated environment, such that the same can cycle on and off as required. In this manner, the on-off sprinkler head provides maximum water pressure to the hottest areas of the fire, and simultaneously alleviates unnecessary water damage in those areas in which the fire has been extinguished.

Some on-off sprinkler heads, such as those illustrated in U.S. Pat. No. 3,874,455, are provided with reciprocating valves to control the flow of fire extinguishing fluid therethrough. This reciprocating valve arrangement typically obstructs and impedes the flow of fluid through the valve, and thereby decreases the fire fighting effectiveness of the device. Heretofore, such sprinkler heads also included various operative elements, such as supports, springs, and the like, which are disposed directly in the emitted stream of the fire extinguishing fluid, thereby seriously disrupting the spray pattern discharged from the head. Also, such designs require a specially shaped deflector plate, which can not be easily interchanged with other deflector plate designs to adapt a single sprinkler head configuration to a variety of spray patterns and/or different applications.

SUMMARY OF THE INVENTION

The principal objects of the present invention are: to provide an on-off sprinkler head for fire extinguishing systems having increased fire fighting effectiveness; to provide such a sprinkler head which includes a housing adapted for connection with a variety of differently shaped, interchangeable deflectors for varying spray patterns in accordance with different sprinkler head applications; to provide such a sprinkler head having a reciprocating valve and offset motor design for increased spraying efficiency; to provide such a sprinkler head having a temperature sensor portion mounted upstream of the deflector to alleviate premature closing of the reciprocating valve; to provide such a sprinkler head which is particularly adapted for dry pendant applications; to provide such a sprinkler head having an unobstructed discharge orifice which emits a solid, uninterrupted stream of fire extinguishing fluids therefrom; to provide such a sprinkler head having a reciprocating valve located at a elevation above the lower surface of the fluid pipes to prevent freezing of the valve members; to provide such a sprinkler head having a housing with multiple interconnected sections to facilitate assembly and installation; and to provide such a sprinkler head which is economical to manufacture, efficient in use, capable of a long operating life, and in particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENTS

Figures 1, 2, 3:
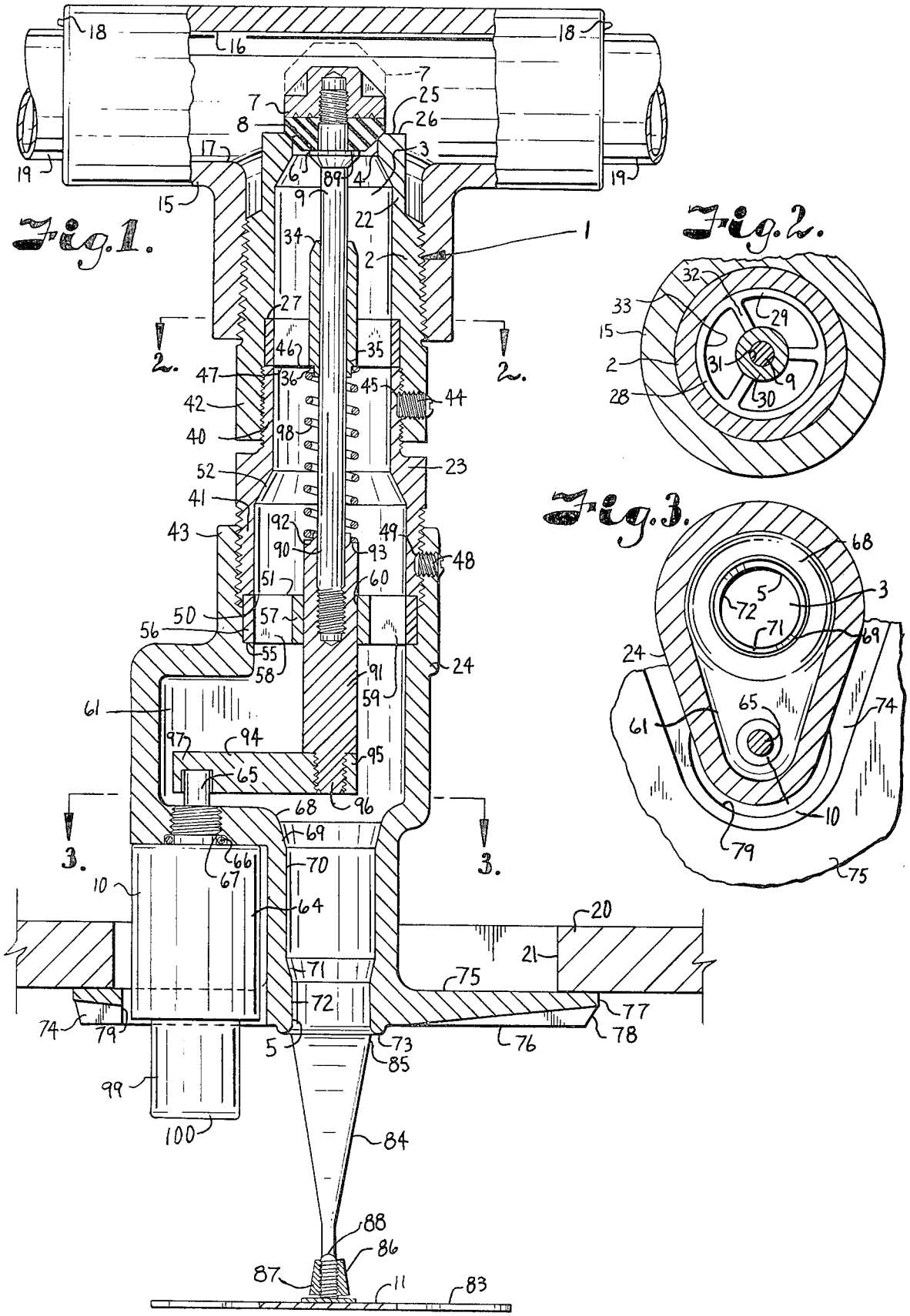
FIG. 1 is a vertical cross sectional view of an on-off sprinkler head embodying the present invention, shown installed in a fire extinguishing system.
FIG. 2 is a horizontal cross sectional view of the sprinkler head taken along the line 2—2, FIG. 1.
FIG. 3 is a horizontal cross sectional view of the sprinkler head taken along the line 3—3, FIG. 1.

For purposes of description herein, the terms "upper", "lower", "right", "left", "rear", "front", "vertical", "horizontal", and derivatives thereof shall relate to the invention as oriented in FIG. 1, however, it is to be understood that the invention may assume various alternative orientations, except where expressly specified to the contrary.

The reference numeral 1 generally designates an on-off sprinkler head for fire extinguishing systems, and comprises a housing 2 having a central cavity 3 with an inlet aperture 4 and a discharge orifice 5 disposed at opposing ends thereof in an aligned orientation. A reciprocating valve 6 with a valve head 7, a mating seat 8 and a stem 9 is mounted axially in the central cavity 3, and controls the flow of fire extinguishing fluid therethrough. A temperature responsive, on-off drive motor 10 is connected with the free end of the valve stem 9 and reciprocates the valve head 7 with respect to the valve seat 8 in response to selected temperature changes. The drive motor 10 is mounted in the housing 2 in a position axially offset from the aligned inlet aperture 4 and discharge orifice 5, whereby during a discharge condition, the fire extinguishing fluid flows substantially unimpeded through the valve, and a solid, uninterrupted stream of the fluid is emitted from the discharge orifice. The valve includes a deflector 11 on which the fluid stream impinges and is dispersed into a spray.

The sprinkler head 1 is adapted for use in a variety of applications, and in the illustrated structure, is shown attached to a threaded tee fitting 15, and is positioned in a pendant orientation, wherein the discharge orifice 5 is oriented downwardly. The tee fitting 15 includes upper and lower surfaces 16 and 17, and threaded ends 18, which are interconnected with corresponding pipe ends 19. The pipe ends 19 form a portion of a network (not shown) which is adapted to carry a fire extinguishing fluid, such as water, therethrough. In the illustrated pendant orientation, the sprinkler head is mounted to a structural support portion of the building ceiling (not shown), and extends downwardly through an aperture 20 in a suspended or dropped ceiling portion 21 of the building, whereby the deflector 11 and a sensor portion of the drive motor 10 are located within the building room.

The sprinkler head housing 2 is threadedly connected with the depending end 18 of the tee fitting 15, and has a generally cylindrical shape. The illustrated housing includes three threadedly interconnected portions 23-24 to facilitate assembly and installation. The upper housing portion 22 includes the valve seat 8 therein, which is disposed at the uppermost free end 25 of the upper housing portion, and is frustroconical in shape. The uppermost surface 26 of the housing free end 25, in which the valve seat 8 is positioned, is disposed at an elevation above the lower surface 17 of the tee fitting 15, such that the valve head and seat 7 and 8 are not disposed in any residual water which might remain in the fluid pipes 19. As a result of this arrangement, the valve experiences increased longivity, and will not freeze shut. The central cavity 3 of the upper housing portion 22 expands radially outwardly past the inlet aperture 4, and includes a recess or shoulder 27 in which a guide 28 is mounted. As best illustrated in FIG. 2, the guide 28 is annular in shape, and includes an outer ring 29 which abuts the side walls of the shoulder 27 (FIG. 1), and an inner ring 30 having a central aperture 31 therethrough which slidingly receives the valve stem 9 therein to position the same centrally within the valve and facilitate reciprocating motion of the same. The inner and outer guide ring 29 and 30 are interconnected by a plurality of radially extending, spaced apart webs or spokes 32 which extend thereinbetween and rigidly interconnect the two ring members. The spaced apart spokes 32 form openings 33 thereinbetween which allow the fire extinguishing fluid to flow freely therethrough. As best illustrated in FIG. 1, the inner ring 30 is elongate with a axial length greater than that of the outer ring 29, and is in the shape of a sleeve with a tapered end 34 extending upwardly of the body portion of the guide 28. The inner ring 30 also includes a lower end 35 which has a ridge or shoulder 36 therein for purposes which will be described in detail hereinafter.

The medial housing portion 23 includes upper and lower ends 40 and 41 which threadedly interconnect the corresponding end portions 42 and 43 of the upper and lower housing portions respectively. A first set screw 44 extends through the lower portion of the upper housing side wall and mates with a recess 45 in the medial housing portion 23 to positively lock the upper and medial housing portions together. In the locked position, the upper end 46 of the medial housing abuts the lower surface 47 of the guide outer ring 29, and urges the guide firmly against the shoulder 27 and retains the same in place. In like manner, the upper portion of the lower housing 24 includes a set screw 48 which extends therethrough and mates in a recess 49 in the lower portion of the medial housing 23, and positively interlocks the same. The lower end 50 of the medial housing engages the upper edge of the second guide member 51 and retains the same in an assembled position. The central cavity 3 in the medial housing 23 expands radially outwardly at a central portion 52 thereof.

The lower housing 24 has the upper end 43 thereof threadedly attached to the medial housing 23 in the above described manner, and is provided with a recess or shoulder 55 in which the second guide 51 is disposed. The second guide 51 is similar in shape to the first guide 28, and includes outer and inner rings 56 and 57 which are interconnected by radially extending webs 58. The webs 58 are spaced apart and form apertures 59 thereinbetween which allow the fire extinguishing fluid to flow freely therethrough. The inner ring 57 includes a central aperture 60 therethrough which is axially aligned with the first guide inner ring aperture 31 and the valve stem 9. An intermediate portion of the lower housing 24 includes an offset area 61 which is spaced laterally apart from the axis of the central cavity 3. As best illustrated in FIG. 3, the offset housing portion 61 has a generally ovate horizontal cross sectional shape, wherein the discharge orifice 5 is disposed at a larger end of the same, and the drive motor 10 is positioned at a smaller end of the offset housing portion. In the illustrated structure (FIG. 1), the drive motor 10 is threadedly attached to a bottom wall of the offset housing portion 61, with the body 64 of the motor 10 depending therefrom, and a motor piston 65 extending into the offset housing cavity. An O-ring 66 is positioned in a recess 67 in the lower surface of the offset housing portion 61 between the motor 10 and the housing, and forms a seal thereinbetween to prevent water in the central cavity from entering the body 64 of the motor.

The lower portion of the lower housing 24 extends downwardly from the housing offset portion 61 and includes the discharge orifice 5, which commences at a rounded edge area 68 and tapers inwardly along a frustroconical surface 69 to an elongate, cylindrically shaped medial portion 70. At the lower edge of the cylindrical portion 70, the discharge orifice again tapers inwardly along a second frustronconical surface 71 to a second cylindrical portion 72 of reduced diameter, which in turn terminates at a rounded edge 73. The inward taper of the discharge orifice at surfaces 69 and 71 serves to concentrate the fluid into a compact solid stream. A flange or cover plate 74 is connected with an extends radially outwardly of the discharge orifice 5 at the lower portion thereof, and includes flat upper and lower surfaces 75 and 76 respectively, and an outer circumferential rim 77 with a beveled edge 78. The upper surface 75 of the cover plate 74 is positioned adjacent to the lower surface of the ceiling 20, and the diameter of the rim 77 is slightly larger than that of the ceiling aperture 21, whereby the body portion of the sprinkler head is concealed above the ceiling and is not visible from the building room. The cover plate 74 includes an aperture 79 therethrough which is shaped to receive the body portions 64 of the drive motor 10 therein.

The deflector 11 is of a conventional construction, and includes a lower plate 83 which is shaped to divert and disperse the water emitted from the discharge orifice 5 into a preselected spray pattern. The plate 83 is connected with and supported by a U-shaped arm or strut 84, with the spaced apart ends 85 thereof attached to the housing 24 at opposing sides of the discharge orifice 5. In the illustrated structure, the arm 84 is integral with the housing 24. The arm 84 is provided with an internally threaded sleeve 86 at a central portion thereof, which tapers outwardly at the bottom in a manner which facilitates dispersing the water stream onto the deflection plate 83. The deflection plate 83 is threadedly connected in the sleeve 86 by a threaded stud 87, which is preferably provided with a tapered free end 88 to improve the spray pattern. The threaded attachment of the deflector plate 83 to the support arm 84, in conjunction with the shape and character of the stream of fluid flowing from the discharge orifice 5 enables the user to attach one of the variety of differently shaped deflectors plates to the structure to modify sprinkler head spray for various applications, as explained more fully hereinafter.

The reciprocating valve 6 is mounted axially within the central cavity 3, and controls the flow of the fire extinguishing fluid therethrough. The illustrated valve head 7 is frustroconical in shape, and adapted to mate with the similarly shaped valve seat 8 to form a secure, watertight seal therebetween. The valve head 7 is threadedly attached to the upper end of the valve stem 9, and the lower portion of the valve head seats firmly against a shoulder portion 89 of the valve stem. The valve stem 9 is slidingly received in the central aperture 31 of the upper guide 28, and the lower end 90 thereof is threadedly connected with a axially oriented extension member 91. The extension member 91 is slidingly received in the central aperture 60 of the lower guide 51, and includes an upper end 92 with a circumferential recess 93. A transversely oriented, offset arm 94 has one end 95 thereof fixedly connected with the lower end 96 of the extension 91 by means such as the illustrated thread arrangement. The outer end 97 of the extension 91 includes an aperture therethrough in which the free end of the motor piston 65 is received. A coil spring 98 is positioned concentrically over the valve stem 9 with the ends thereof engaging the recess 36 of the upper guide 28, and the recess 93 in the extension 91 respectively, and is pretensed to a condition which urges the valve assembly 6, extension 91, arm 94, and motor piston 65 in a downwardly direction (as oriented in FIG. 1), whereby the valve head 7 and seat 8 are retained in a normally closed and sealed position.

The drive motor 10 is of a conventional on-off design, wherein the body is filled with a material which expands and retracts in reaction to temperature change, and the piston 65 is accordingly translated. In the illustrated structure, the outer side wall of the drive motor 10 is spaced apart from the adjacent wall of the sprinkler head housing to provide a thermal barrier thereinbetween, and the drive motor body 64 extends through the cover plate aperture 79. The drive motor 10 includes a temperature sensor element 99 which depends from the body 64 of the drive motor, and extends downwardly of the lower surface 76 of the cover plate 74. The sensor element 99 is located wholly within the building room in which the sprinkler head is located, and thereby quickly senses temperature changes which occur therein. The lowermost surface 100 of the temperature sensing element 99 is disposed a spaced apart distance upwardly from or upstream of the deflector plate 83, such that the fire extinguishing fluid which impinges upon the deflector plate 83 will not spray onto the temperature sensor 99 and cause premature closing of the reciprocating valve 6. As best illustrated in FIG. 3, the drive motor 10 is mounted in the housing 24 in a position axially offset from the central cavity 3, so as not to interrupt or interfer with fluid flow therethrough.

In use, the sprinkler head 1 is preferably connected in a dry-type fire extinguishing system in a pendant orientation. A deflector plate 83 is selected by the user in accordance with the particular requirements of a specific application, with factors such as line pressure, line diameter, sprinkler head elevation, room size, and the like, taken into account. The selected deflector plate is then connected with an associated sprinkler head by screwing the threaded stud 87 into the sleeve 86. The sprinkler head is then attached to the associated tee fitting 15 in a manner such that the valve head and seat 7 and 8 are disposed at an elevation above the lower surface 17 of the tee fitting, whereby moisture, condensation, and other forms of water will not freeze around the valve and place the same in an inoperative condition. The coil spring 98 retains the valve in a normally closed and sealed position. Should a fire erupt in the vicinity of the shower head, the temperature sensing element 99 detects the increase in temperature, and should that temperature exceed a predetermined level, the piston 65 will extend, thereby translating the valve assembly, and lifting the valve head 7 a spaced apart distance from the valve seat 8. In a dry system, the air in the pipe 19 is then released through the valve, thereby activating a pressure regulating device and tripping an associated hydraulic valve which releases fire extinguishing fluid through the system. The fire extinguishing fluid flows through the space formed between the spaced apart valve head and seat, thence axially downwardly through the central cavity 3 of the sprinkler head, and is emitted from the discharge orifice 5 in the form of a solid, uninterrupted stream which impinges upon the deflector plate 83 and is dispersed into a spray. Because the motor 10 is axially offset from the central cavity 3, the fire extinguishing fluid flows substantially unimpeded through the central cavity, thereby reducing resistance to the flow and increasing the discharge rate for a given system pressure and network layout. Because the sensor element 99 of the drive motor 10 is positioned a spaced apart distance on the upstream side of the deflector plate 83, spray from the deflector is not likely to impinge upon the sensor and cause premature closing of the reciprocating valve.

It is to be understood that while I have illustrated and described certain forms of my invention, it is not to be limited to the specific forms or arrangement of parts herein described and shown, except insofar as such limitations are included in the following claims.

What is claimed and desired to secure by Letters Patent is:

1. An on-off sprinkler head for fire extinguishing systems, comprising:

(a) a housing having a central cavity with an inlet aperture and a discharge orifice disposed at opposing ends of said central cavity in an aligned orientation; said discharge orifice being unobstructed and including upstream and downstream sides respectively;

(b) a reciprocating valve mounted axially within said central cavity and selectively controlling the flow of fire extinguishing fluid therethrough; said valve including an axially oriented valve head and mating valve seat, and an axially extending valve stem having one end thereof spaced apart from said discharge orifice on the upstream side thereof, such that said discharge orifice is unobstructed;

(c) a temperature responsive, on-off drive motor connected with the other end of said valve stem and reciprocating the valve head with respect to the valve seat in response to selected temperature changes; said drive motor being mounted in said housing in a position axially off set from said aligned inlet aperture and discharge orifice, whereby during a discharge condition, the fire extinguishing fluid flows substantially unimpeded through said central cavity, and a solid, uninterrupted stream of said fluid is emitted from said discharge orifice;

(d) a deflector spaced apart and connected with said housing at the downstream side of said discharge orifice for deflecting the stream of fluid flowing therefrom and dispersing the fluid into a spray; and (e) an off set arm connecting said drive motor with said valve stem.

* * * * *